United States Patent [19]

Lang

[11] 4,200,439

[45] Apr. 29, 1980

[54] GASIFICATION PROCESS USING ION-EXCHANGED COAL

[75] Inventor: Robert J. Lang, Baytown, Tex.

[73] Assignee: Exxon Research & Engineering Co., Florham Park, N.J.

[21] Appl. No.: 861,826

[22] Filed: Dec. 19, 1977

[51] Int. Cl.[2] ..... C10J 3/00; C10J 3/54

[52] U.S. Cl. ..... 48/210; 44/1 R; 48/202

[58] Field of Search ..... 48/202, 206, 210; 252/179, 373; 423/157, 181, 432; 44/1 R, 16; 201/38

[56] References Cited

U.S. PATENT DOCUMENTS

| | | | |
|---|---|---|---|
| 2,693,452 | 11/1954 | Goedkoop | 252/179 |
| 3,120,426 | 2/1964 | Crawford | 423/432 |
| 4,092,125 | 5/1978 | Stambaugh et al. | 48/210 |

OTHER PUBLICATIONS

"A Novel Approach to Gasification of Coal Using Chemically Incorporated Catalysts", Chauhan et al., 173rd ACS Nat. Meeting 3/20-3/25/77, Paper 22#1, 38-52 (1977).

The Use of Catalysts in Coal Gasification, Johnson Catal. Rev. Sci. Eng. 14(1) (1976), pp. 131-137 and 142-148.

Ion Exchange, Helffevil, pp. 5, 6, 17; 1962.

*Primary Examiner*—Richard V. Fisher

*Assistant Examiner*—Peter F. Kratz

*Attorney, Agent, or Firm*—Wayne Hoover; Llewellyn A. Proctor

[57] ABSTRACT

A process wherein Group I-A or Group II-A metals, or both, can be ion-exchanged onto coal, especially a high rank coal, notably a subbituminous or bituminous coal, to produce a highly reactive carbonaceous feed for use in gasification reactions, especially to produce high-BTU fuel gases, but also intermediate-BTU or synthesis gas. The coal is treated by contact with an alkaline solution of an admixture of compounds, inclusive of a soluble alkali metal salt and an excess of an alkaline earth metal hydroxide, each of which interacts one with the other to form an alkali metal hydroxide, and an insoluble alkaline earth metal salt precipitate. The coal is treated in a single step by contact with the solution within which both the Group I-A and II-A metal compounds are dispersed, or dissolved. Where the coal does not contain adequate ion-exchange sites, these are formed by reaction between the alkali metal hydroxide, generated by the reaction, and the coal, and in turn all or a portion of the alkali metal cations are exchanged or replaced by alkaline earth metal cations which are present in the alkali metal hydroxide solution that is formed. Preferably, the treatment is continued until substantially all of the alkali metal cations have been replaced by the alkaline earth metal cations, and then the solution is evaporated while in contact with the coal to redeposit and physically disperse the alkali metal upon the coal.

17 Claims, No Drawings

GASIFICATION PROCESS USING ION-EXCHANGED COAL

Before the turn of the century it was known that hydrocarbon gases and liquids, tars and chemicals could be obtained not only from petroleum, but from coal and other carbonaceous solids. Very early processes employed destructive distillation, coal being transformed into gases and petroleum-like liquid products. Primary emphasis in many of these processes is on gasification of the coal with the objective of improving processes for the production of water gas, producer gas, or hydrogen, as opposed to the production of coal liquids. For the past several decades, due to disallocations of supplies, there have been reoccurring periods of interest in the gasification of coal to produce fuel gases, first primarily in Europe; and then, in this country. The art reflects the various periods of interest in terms of peaks defined by large numbers of patents, and literature. Presently existing and projected shortages of natural gas in this country have sparked a renewed and very keen interest in the gasification of coal, and it appears that this will be a long-range trend. Consequently, intensive research and development efforts are now underway to produce synthetic high-BTU, intermediate-BTU and synthesis fuel gases for commercial usages.

It was early recognized that some mineral and trace inorganic constituents naturally present in some coal could exert favorable catalytic influences in gasification reactions vis-a-vis thermal reactions, and a variety of catalytic materials have been added to coal to alter the natural chemistry inherent in various of the early coal gasification processes. The thrust of present research is to develop processes for the production of synthetic high-BTU gases with far higher efficiencies than was possible in the classical European, or early Euro-American processes. There are, however, inherent chemical kinetic limitations in coal gasification processes which have defied solution, and these problems are yet unsolved. Yet, solution is essential, and there remains a strong interest in providing better coal gasification processes, or catalysts for use in catalytic coal gasification processes.

There is a profusion of information covering catalytic coal gasification processes; both domestic and foreign, this including both patents and literature. Illustrative thereof is a recent paper by James L. Johnson; Catal. Rev. Sci. Eng., 14(1) pp. 131–152 (1976), which includes a survey of the catalytic gasification art. Therein various materials have been characterized as generally useful catalysts for the gasification of coal, or carbonaceous solids, the survey naming various metals, metal oxides, metal halides, transition metals, and iron carbonyls. Group I and Group II metal compounds as a class, notably potassium carbonate, sodium carbonate, potassium chloride, sodium chloride, and calcium oxide are given special recognition, it being suggested that few catalysts are as effective in promoting gasification rates as alkali metals, and that none are more active. In the article, the catalytic properties of sodium and calcium are specifically discussed. Each of these cations, respectively, have been ion-exchanged into lignite, exchange being possible, and attributed to the presence of the carboxyl functional groups known to be present in lignite, and other low rank coal structures. Gasification rates with steam-hydrogen mixtures were increased when sodium or calcium were added to the lignite via the exchange mechanism. However, attempts to add sodium or calcium to bituminous coals via ion-exchange were unsuccessful due, as suggested in the article, to the lack of exchange sites on high rank coals.

In a catalytic coal gasification process, i.e., one whose object is to produce high-BTU gas, steam, and particulate coal are fed to a gasifier at elevated temperature and pressure and converted to a synthesis gas, or gaseous mixture of high methane content, which contains significant amounts of carbon monoxide and hydrogen which must also be catalytically converted in situ or ex situ within the gasifier to methane. Practical objectives require increased thermal efficiencies, with simultaneous reduction of reactor size and temperature, as well as simplification and reduction of the steps involved in the operation. It has been recognized, and is evident that these and other objectives might be obtainable by improved catalytic materials added to the mass of feed coal. Though much of the prior art disclosures relate to disclosures of physical admixtures of a catalyst and a coal, it has been recognized that a through dispersion of the catalyst throughout the coal better promotes gasification rates, and activity than a physical mixture. In the past, however, whereas it has not proven particularly difficult to effectively, uniformly, disperse catalytic materials throughout low rank coal structures, this has not been true of high rank coals, notably subbituminous and bituminous coals. This is because low rank coals have active sites which makes feasible the exchange of cations onto these sites. With high rank coals, however, the coal particle is devoid of such sites.

Nonetheless it has been recognized, and disclosed in pending application Ser. No. 812,032, filed July 1, 1977, by Richard C. Neavel and Robert J. Lang, herewith incorporated by reference, that even high rank coals can be subjected to partial oxidation to generate active exchange sites, and the oxidized coal then ion-exchanged with a suitable catalytic metal cation to improve catalytic performance in the overall gasification process. The data presented therein shows that the gasification rate of bituminous coal is increased with increased concentrations of either the alkali metal, or alkaline earth metal cations present in the coal structure. Though the alkali metal cations, notably potassium are shown the most active, it is also shown that calcium, which is relatively inactive when incorporated as a physical mixture with coal, becomes quite active catalytically when incorporated with the coal via ion-exchange. Moreover, even the catalytic activity of the alkali metals are further improved when ion-exchanged into the coal as contrasted with physical admixture of same with the coal.

In U.S. application Ser. No. 861,824, filed Dec. 19, 1977 of even date herewith) by Richard C. Neavel, it is further disclosed that suitable ion-exchange sites for the exchange of alkaline earth metals onto coal, normally devoid of such sites, can be produced by subjecting the coal to treatment with a solution of an alkali metal hydroxide and, in fact, that the composition which is only partially exchanged with the alkaline earth metal ions, after incorporation of the alkali metal ions, and contains both the alkaline earth and alkali metals provides enhanced gasification rates and increased methanation activity as contrasted with a composition otherwise similar except that it contains only one of the metals. Moreover, in U.S. application Ser. No. 861,825, filed Dec. 19, 1977 of even date herewith) by Robert J. Lang a process is disclosed wherein, using natural formation of exchange sites by oxidation, and exchange with alkaline earth ions, or direct treatment with an alkali solution and treatment with an alkaline earth metal to incorporate the alkaline earth metal, the treated coal is thereafter physically admixed with an alkali metal compound to enhance gasification rates and methanation activity of the compositions as feeds to a gasification process.

It has also been reported by Batelle Memorial Institute that "Batelle-treated coal" has been prepared from a high rank coal, i.e., Pittsburgh No. 8 coal in Batelle Memorial Institute's Hydrothermal Coal process by treating in aqueous sodium hydroxide/calcium oxide (CaO) solution (0.13:1 CaO to coal) at 250° C. (480° F.), up to 3% of the CaO being chemisorbed on the coal. It is disclosed that a 850° C. (1560° F.) and 500 psig 65% of the treated coal can be converted by steam in less than three minutes compared with 90 minutes for untreated coal. S. P. Chauhan (Batelle Memorial Institute, Columbus Lab), K. Woodcock (E.R.D.A.) et al 173rd ACS National Meeting (New Orleans 3/20-25/77) ACS Div. Fuel Chem. Prepr. 22 #1:38-52 (1977).

Albeit these discoveries have considerably enhanced the efficiency of the process, and improved economies, there are nonetheless profound differences in the costs of the various compounds used as sources of the respective alkali or alkaline earth metals, or both, desired for incorporation into the coal. There are thus profound differences between the costs of various alkali metal or alkaline earth metal salts, even where the same metal species constitutes the metallic portion thereof. There are also major differences between the costs of salts, and the costs of other compounds which contain similar metal species, e.g., metal hydroxides.

It is, accordingly, a primary objective of the present invention to provide a process for the treatment of coals, notably high rank coals, or coals which have insufficient active sites to permit ion-exchange, with combinations of relatively inexpensive compounds which provide alkali or alkaline earth metals, or both, to render such coals amenable to gasification at increased rates, and to achieve chemical equilibrium, particularly in the production of high-BTU fuel gases.

A particular object is to provide a process of such character wherein bituminous coals can be converted into a highly active carbonaceous feed for use in coal gasification reactions, especially for the production of high-BTU fuel gases, by treatment of coal with combinations of relatively inexpensive compounds which incorporate both alkali and alkaline earth metals onto the coal.

These objects and others are achieved in accordance with the present invention embodying a novel process wherein Group I-A or Group II-A metals (Periodic Table of the Elements, Sargent-Welch Scientific Company, Copyright 1968), or both, can be ion-exchanged onto coal, preferably a high rank coal, notably a subbituminous or bituminous coal, by contacting the coal with an alkali solution of an admixture of compounds, preferably a hot solution of such compounds, inclusive of a soluble alkali metal salt and an alkaline earth metal hydroxide, each of which interacts one with the other to form an alkali metal hydroxide, and an insoluble alkaline earth metal salt precipitate. The coal is treated in a single step by contact with the solution within which both the Group I-A and II-A metal compounds are dispersed, or dissolved. Where the coal does not contain adequate ion-exchange sites, these are formed by reaction between the alkali metal hydroxide generated by the reaction, and the coal, and in turn all or a portion of the alkali metal cations are exchanged or replaced by excess alkaline earth metal cations which are present in the alkali metal hydroxide that is formed. Preferably, the treatment is continued until substantially all of the alkali metal cations have been replaced by the alkaline earth metal cations, and then the solution is evaporated while in contact with the coal to redeposit and physically disperse the alkali metal upon the coal. Enhanced gasification rates and increased methanation activity are achieved by gasification of the so-treated coal, or composition which contains both the Group I-A and Group II-A metals, as contrasted with a composition otherwise similar except that it contains an equal molar quantity of either the Group I-A metal or Group II-A metal, rather than both metals. The Group I-A or Group II-A metals can act as a sulfur absorbent during the gasification, or on combustion of the coal.

The presence of the alkali metal hydroxide formed by the interchange permits the formation within the coal of reactive sites, or ion-exchange sites on which the alkaline earth metals can be exchanged, but the sites are created from an alkali metal hydroxide formed in situ from an interaction between an inexpensive alkali metal salt and an inexpensive alkaline earth metal hydroxide. For example, it is known that active sites are formed on coal by direct contact and treatment with a sodium hydroxide solution, but sodium hydroxide is rather expensive. Sodium carbonate, however, is rather inexpensive as is lime, and hence sodium carbonate, $Na_2CO_3$, can be dissolved in water and hydrated lime, $Ca(OH)_2$, added thereto, such that sodium hydroxide is formed in situ from the alkali metal carbonate as a source of sodium ions and the alkaline earth metal hydroxide as a source of hydroxyl ions. $CaCO_3$ precipitates out. In such solution the sodium hydroxide reacts with the coal to form ion-exchange sites, and as these sites are formed, alkaline earth metal cations from excess dissolved $Ca(OH)_2$ are exchanged thereupon as contact of the coal with such solution is continued.

Sufficient of the alkaline earth metal cations are contained within the solution for substantial exchange and replacement of the alkali metal from the coal at ambient conditions by soaking the coal in the solution for a period ranging at least about 0.25 hour, suitably from about 1 hour to about 100 hours, preferably from about 24 hours to about 96 hours. The contact period, however, can be decreased by reduction of the temperature. Thus, lime is not very soluble, especially in basic solution and an insoluble calcium carbonate precipitate is formed such that relatively few calcium ions are present in the solution. However, sufficient of the calcium cations are maintained in solution for reasonably rapid exchange of calcium onto the active sites to produce acceptable gasification rates, and methanation activity, by elevating the temperature of the solution.

Virtually any alkaline earth metal hydroxide, or alkaline earth metal compound which will decompose and form a hydroxide in situ, can be employed in the practice of this invention. Exemplary of such compounds are hydroxides formed from magnesium, calcium, strontium and barium, with calcium being preferred. The alkali metal salt is constituted of any of lithium, rubidium, cesium, but particularly sodium or potassium, in combination with an anion which provides a soluble salt, and forms an insoluble molecular species with the specific alkaline earth metal of the alkaline earth metal hydroxide employed in the admixture added to the solvent. Exemplary of alkali metal salts suitable for use in the practice of this invention are sodium bicarbonate and sodium carbonate which form an insoluble salt on reaction in solution with barium, strontium or calcium; sodium oxalate, potassium oxalate which form an insoluble salt on reaction with barium, strontium or calcium; sodium chromate or cesium chromate which form an insoluble precipitate or reaction in solution with barium or strontium; sodium fluoride which forms an insoluble precipitate with strontium; and the like.

In a preferred embodiment, a particulate coal containing less oxygen in an active form than would be required to impart from about 1 to about 10 wt. percent calcium ion, particularly a bituminous coal, is contacted, heated or boiled and soaked in an alkali solution of an admixture of compounds, inclusive of a soluble alkali metal salt and an alkaline earth metal hydroxide in excess of that amount required to react to form an alkali metal hydroxide and an insoluble alkaline earth metal salt precipitate. The solution formed, preferably with water as a solvent, is characterized as an aqueous alkali hydroxide of from about 0.1 to about 10 molarity, preferably from about 0.5 to about 2 molarity, and this solution is maintained in contact with said coal at conditions sufficient to form active sites onto which can be exchanged between about $5\times10^{-4}$ to about $8\times10^{-3}$ gram atom equivalents of a Group I-A or Group II-A metal, or both, per gram of coal, preferably from about $1\times10^{-3}$ to about $5\times10^{-3}$ gram atom equivalents of a Group I-A or Group II-A metal, or both, per gram of coal. Suitably, the treatment is conducted at temperatures ranging from about 20° F. to about 250° F., preferably from about 180° F. to about 220° F., suitably for periods ranging from about 0.1 to about 48 hours, preferably from about 0.25 hour to about 6 hours, more preferably from about 0.25 hour to about 1 hour, when the temperature of the solution is maintained within the expressed preferred ranges.

In the process of this invention, suitably from about 0.1 atomic percent to about 10 atomic percent, preferably from about 1 atomic percent to about 8 atomic percent, based on the carbon present, of the Group II-A metal, or metals, calculated as metallic metal is incorporated via the ion-exchange mechanism onto the coal, and generally from about 0.1 atomic percent to about 10 atomic percent, or more often from about 0.5 atomic percent to about 3 atomic percent of the Group I-A metal cation, based on the carbon present in the char formed by pyrolysis or devolatilization. In the reaction which takes place, ion-exchange sites are formed and the Group I-A metal is incorporated within the structure, the Group I-A metal, or alkali metal, being in turn exchanged or replaced with a Group II-A metal, or metals, via ion-exchange. In either event, however, in a preferred embodiment the solution is evaporated while in contact with the coal so that esentially all of the Group I-A, or alkali metals, which remain in solution are physically dispersed onto the structure. Suitably therefore, the coal is one which contains, after these treatments a sum-total of from about 0.2 atomic percent to about 20 atomic percent, preferably from about 1.5 atomic percent to about 11 atomic percent, of the Group I-A and Group II-A metals, based on the carbon present in the char formed by pyrolysis or devolatilization.

The process of this invention is generally applicable for the inclusion of Group I-A and Group II-A metals in virtually any type of coal, including lignite, brown coal, peat, and the like, subbituminuous coals such as Wyodak and the like, and bituminous coals such as Illinois No. 6, Pittsburgh No. 8 and the like. The process, however, has special utility in the treatment of the high rank coals, notably the subbituminous and bituminous coals which have insufficient natural sites to permit high per se dispersion of the Group I-A and Group II-A metals into the structure.

In the past, low rank coals have been successfully treated via ion-exchange with alkali or alkaline earth metal cations, including, e.g., sodium or calcium, because of natural exchange sites. The exchange of alkali or alkaline earth metal cations, particularly the latter, onto bituminous coals, however, has been ineffective because of the nature of bituminous coals which are lacking in natural exchange sites. In accordance with the present process, nontheless, ion-exchange sites are created in the coal by treatment with the strong alkali solution which is generated by reaction between the admixture of the soluble alkali metal salt and alkaline earth metal hydroxide, this making feasible the addition, or incorporation of considerably greater amounts of alkaline earth metal cations into the coal than heretofore believed possible. Whereas substantially complete exchange of alkaline earth metal into the created ion-exchange sites is possible, the presence of both alkali and alkaline earth metal cations in the coal is highly preferable for it has been found that gasification rates are considerably higher for a coal which contains both types of metal vis-a-vis a coal similarly treated, and otherwise similar except that it contains either an alkali metal or alkaline earth metal to the substantial exclusion of the other. After complete exchange and replacement of substantially all of the Group I-A metal by a Group II-A metal, in any event, the Group I-A metal can be physically dispersed upon the structure to provide a highly reactive feed for use in gasification reactions.

Gasification processes as generally known in the art can be improved with respect to yield or conversion rate, or both, when the process of this invention is employed in the formation of the novel carbonaceous feed compositions. The compositions are reacted with a gaseous species or a mixture of gaseous species at elevated temperatures, and generally elevated pressures to produce and optimize the composition of the fuel gases. The gaseous species generally employed as reactants include oxygen, steam, hydrogen, and carbon oxides such as carbon dioxide. Generally, temperature, pressure, flow rate, mole ratios and relative mole ratios depend on the specific process employed and the actual products desired therefrom. In any event, the composition of the gaseous products are altered by the particular catalyst employed. For example, the products resulting from the gasification of coal with steam is enriched in methane by judicious selection of the optimum alkali and alkaline earth metal, and concentrations thereof within the feed composition, to promote the conversion of carbon monoxide and hydrogen to methane. Generally sodium or potassium in relatively high concentrations are most preferred when maximum methane production from gasification by steam is desired, and calcium in high concentration is most preferred when production of carbon monoxide and hydrogen by steam gasification is desired. Gasification is generally accomplished by contacting the treated coal with steam at a temperature within the range from about 750° F. to about 1850° F. at a steam flow rate within the range from about 0.2 to about 100 W/W/Hr. Pressure is not critical, but generally ranges from about 0 to about 1000 psig.

These and other features of the present invention will be better understood by reference to the following examples and demonstrations which involve treatment of coals with compounds which incorporate both the Group I-A and Group II-A metals, and runs conducted by gasification of the coal wherein the coal has been treated with compounds which incorporate only the alkali or alkaline earth metal compound onto the coal. All units are in terms of weight unless otherwise specified.

EXAMPLES

It is known that a bituminous coal will not take up appreciate calcium in an active form, to catalyze steam gasification, by simple impregnation. Boiling the coal in a sodium hydroxide solution, however, is known to form ion-exchange sites occupied by the sodium ion which can be exchanged for the calcium ion, and the ion-exchanged coal is catalytically active. Furthermore, it is known that an alkaline earth metal exchanged coal can be promoted with alkali metals to provide a synergistic mixture having exceptional catalytic activity both for increasing gasification rates and methanation activity.

In a series of runs, portions of Illinois No. 6 coal, a bituminous coal, were treated with aqueous solutions, or slurries of admixtures of sodium carbonate and/or lime, at solution boiling temperature, then soaked at ambient temperature, for varying time periods. It was observed that sodium hydroxide was formed and calcium carbonate was precipitated. The sodium hydroxide was found to attack the coal to form sodium ion-exchanged sites, while excess calcium hydroxide dissolved such that calcium ions were exchanged for the sodium ions. Since the hydroxyl ion was found to suppress the solubility of the calcium hydroxide somewhat, a soak time was necessary to achieve adequate calcium ion exchange for the sodium. All of the sodium left in solution was distributed by drying and pyrolysis to form the active sodium promoted calcium catalyst.

For comparative purposes, portions of the coal were also physically admixed with various weight portions of potassium carbonate, a catalyst of known high commercial potential for use in the treatment and gasification of coal. Also, a portion of the coal was treated with a physical admixture of sodium carbonate, and a similar portion of the coal was soaked in a lime slurry. These several treated coal specimens were then dried and gasified at 1300° F., ambient pressure, by injection of steam to provide an average steam:carbon ratio of 7.5 W/W/Hr.

The weight percent of the potassium carbonate, and the weight percent of the sodium carbonate or calcium oxide, or both, in terms of weight percent on coal; the boil or soak periods, and the gasification rates achieved are identified in the table.

Table

Comparison of Na/Ca Catalyst With $K_2CO_3$ On Illinois Coal

| Catalyst | Weight % On Coal | | | Time, Hr. | | Gasification |
|---|---|---|---|---|---|---|
| | $K_2CO_3$ | $Na_2CO_3$ | CaO | Boil | Soak | Rate-%/Hr.(1) |
| $K_2CO_3$ | 10 | — | — | — | — | 72 |
| $K_2CO_3$ | 15 | — | — | — | — | 100 |
| $Na_2CO_3/Ca(OH)_2$ | — | 5 | 8 | 0.5 | 0 | 47 |
| $Na_2CO_3/Ca(OH)_2$ | — | 5 | 8 | 0.5 | 72 | 89 |
| $Na_2CO_3/Ca(OH)_2$ | — | 5 | 8 | 1 | 0 | 47 |
| $Na_2CO_3/Ca(OH)_2$ | — | 5 | 8 | 1 | 1 | 61 |
| $Na_2CO_3/Ca(OH)_2$ | — | 5 | 8 | 1 | 7 | 64 |
| $Na_2CO_3/Ca(OH)_2$ | — | 5 | 8 | 1 | 24 | 75 |
| $Na_2CO_3/Ca(OH)_2$ | — | 5 | 8 | 1 | 96 | 81 |
| $Na_2CO_3$ | — | 5 | — | — | — | 21 |
| $Ca(OH)_2$ | — | — | 2.9(2) | — | 24 | 41 |

(1)Weighted average rate from 0-90% carbon conversion at 1300° F. Weighted average steam/carbon is 7.5 W/W/Hr. Based on carbon actually present.
(2)Actually ion-exchanged on the coal.

These data clearly show, in particular, the promotional effect of sodium on calcium. A comparison of the Na/Ca combination with potassium carbonate, the standard catalyst, shows an activity equal to 13% potassium carbonate. The data illustrates that soak times of 72 to 96 hours are generally necessary for maximum activity to be developed at ambient conditions.

It is apparent that various modifications can be made without departing the spirit and scope of the invention. For example, these alkali-promoted alkaline earth catalysts will also prove effective in the treating of coal derived carbonaceous products such as liquefaction bottoms, and with other gasification agents such as hydrogen and carbon dioxide.

Having described the invention what is claimed is:

1. A process for gasifying coal to produce a fuel gas which comprises:

(a) contacting said coal for a period of time within the range from about 0.1 to about 48 hours with a solution of an admixture of compounds, inclusive of a soluble Group I-A metal salt and an excess of Group II-A metal hydroxide added initially to the solution, each of which interacts one with the other to form a Group I-A metal hydroxide, and an insoluble Group II-A salt precipitate, sufficient to increase the concentration of, and deposit Group I-A metal cations at ion-exchange sites within said coal as contrasted with the state of the coal prior to contact with said solution, at a temperature within the range from about 20° to about 250° F.;

(b) soaking the coal-solution mixture from step (a) at about ambient conditions for a period of time within the range from about 24 to about 96 hours to exchange and replace Group I-A metal cations with Group II-A metal cations and then evaporating the solution to physically disperse the Group I-A metal compounds onto the ion-exchanged coal, and (c) gasifying the treated coal at gasification conditions in a gasification zone to produce fuel gas.

2. The process of claim 1 wherein there is imparted to the coal after treatment with the solution from about $5\times10^{-4}$ to $8\times10^{-3}$ gram atom equivalents of catalytically active cations per gram of coal.

3. The process of claim 1 wherein there is imparted to the coal after treatment with the solution from about $1\times10^{-3}$ to $5\times10^{-3}$ gram atom equivalents of catalytically active cations per gram of coal.

4. The process of claim 1 wherein the coal subjected to treatment with said solution is a bituminous coal.

5. The process of claim 1 wherein the Group I-A metal of the Group I-A metal salt is sodium or potassium.

6. The process of claim 1 wherein the Group II-A metal of the Group II-A metal hydroxide is calcium.

7. The process of claim 1 wherein the soluble Group I metal salt added initially to the solution in contact with the coal is sodium carbonate.

8. The process of claim 1 wherein the soluble Group II metal hydroxide added initially to the solution in contact with the coal is calcium hydroxide.

9. A process for gasifying coal to produce a fuel gas, which comprises:

(a) contacting said coal with an aqueous medium of an admixture of compounds added initially to said medium, inclusive of a soluble Group I-A metal salt and an excess of a Group II-A metal hydroxide, each of which interacts one with the other to form a Group I-A metal hydroxide, and an insoluble Group II-A salt precipitate, in adequate concentration to provide from about a 0.1 molar to about a 10 molar solution, at a temperature within the range from about 180° F. to about 220° F. for a period of time within the range from about 0.25 to about 6 hours to increase the concentration of, and deposit Group I-A metal cations at ion-exchange sites within said coal, as contrasted with the state of said coal prior to contact with said solution; and then (b) soaking the coal-solution mixture from step (a) at about ambient conditions for a period of time within the range from about 24 to about 96 hours to exchange and replace Group I-A metal cations with Group II-A metal cations and then evaporating the solution to physically disperse the Group I A metal compound onto the ion-exchanged coal;

(c) gasifying the treated coal at gasification conditions in a gasification zone to produce fuel gas.

10. The process of claim 10 wherein there is imparted to the coal after treatment with the solution from about $5\times10^{-4}$ to $8\times10^{-3}$ gram atom equivalents of catalytically active cations per gram of coal.

11. The process of claim 10 wherein there is imparted to the coal after treatment with the solution from about $1\times10^{-3}$ to $5\times10^{-3}$ gram atom equivalents of catalytically active cations per gram of coal.

12. The process of claim 9 wherein the coal subjected to treatment is a bituminous coal.

13. The process of claim 9 wherein the Group I-A metal of the Group I-A metal salt is sodium or potassium.

14. The process of claim 9 wherein the Group II-A metal of the Group II-A metal hydroxide is calcium.

15. The process of claim 9 wherein the soluble Group I metal salt added initially to the solution in contact with the coal is sodium carbonate.

16. The process of claim 9 wherein the soluble Group II metal hydroxide added initially to the solution in contact with the coal is calcium hydroxide.

17. The process of claim 9 wherein said contacting is continued for a period of time within the range from about 0.25 to about 1 hour.

* * * * *